US006322747B1

(12) United States Patent
Fukuzumi et al.

(10) Patent No.: US 6,322,747 B1
(45) Date of Patent: Nov. 27, 2001

(54) HIGH-STRENGTH SPRING STEEL

(75) Inventors: Tatsuo Fukuzumi, Tokyo; Hidenori Hiromatsu, Muroran; Motoyuki Satoh, Chiba; Ryo Hara, Soka, all of (JP)

(73) Assignees: Mitsubishi Steel Muroran Inc.; Mitsubishi Steel Mfg. Co., Ltd., both of Tokyo (JP)

( * ) Notice: Subject to any disclaimer, the term of this patent is extended or adjusted under 35 U.S.C. 154(b) by 0 days.

(21) Appl. No.: 09/492,552

(22) Filed: Jan. 27, 2000

(30) Foreign Application Priority Data

Oct. 29, 1999 (JP) ..... 11-309171

(51) Int. Cl.[7] ..... C22C 38/42

(52) U.S. Cl. ..... 420/91; 420/92; 420/93; 420/109; 148/332; 148/335

(58) Field of Search ..... 420/91, 92, 93, 420/109; 148/332, 335, 908

(56) References Cited

U.S. PATENT DOCUMENTS 5,454,883 * 10/1995 Yoshie et al. ..... 148/320
5,525,167 * 6/1996 McVicker ..... 148/335
5,746,842 * 5/1998 Eguchi et al. ..... 148/319
5,776,267 7/1998 Nanba et al. .

FOREIGN PATENT DOCUMENTS 0 943 697 A1 9/1999 (EP) .
11-29839 2/1999 (JP) .
WO 98/51834 11/1998 (WO) .

* cited by examiner

*Primary Examiner*—Roy King
*Assistant Examiner*—Harry D. Wilkins, III
(74) *Attorney, Agent, or Firm*—Pennie & Edmonds LLP

(57) ABSTRACT

A high-strength spring steel having an Hv of at least 600 and an impact value of at least 40 J/cm$^2$, comprising 0.40 to 0.70 wt. % carbon, 1.00 to 2.50 wt. % silicon, 0.30 to 0.90 wt. % manganese, 0.50 to 1.50 wt. % nickel, 1.00 to 2.00 wt. % chromium, 0.30 to 0.60 wt. % molybdenum, 0.25 to 0.50 wt. % copper, 0.01 to 0.50 wt. % vanadium, 0.010 to 0.050 wt. % niobium, 0.005 to 0.050 wt. % aluminum, 0.0045 to 0.0100 wt. % nitrogen, 0.005 to 0.050 wt. % titanium, and 0.0005 to 0.0060 wt. % boron, with phosphorus limited to 0.010 wt. % or less, sulfur to 0.010 wt. % or less, and $O_T$ to 0.0015 wt. % or less, and the remainder being composed of iron and unavoidable impurities. The spring steel has better hardness and toughness than those of existing spring steel.

20 Claims, 2 Drawing Sheets

HIGH-STRENGTH SPRING STEEL

BACKGROUND OF THE INVENTION

1. Field of the Invention

The present invention relates to a high-strength spring steel used in automobiles, aircraft equipment, various types of industrial machinery, and so forth.

2. Description of the Related Art

In an effort to improve fuel economy, there has been an urgent need in recent years for weight reductions in automobiles. These reductions are required of many different parts, with suspension parts being no exception. One way of handling this is to set a higher design stress for suspension springs. Specifically, it is effective to increase the strength of springs. Si-Mn-based SUP7 and Si-Cr-based SUP12 are the main types of suspension spring steel in use at the present time, but further increases in design stress will require higher strength than with these types of steel. The strength of a steel material is generally closely related to its hardness, but there was concern that increasing the hardness of spring steel would lower its toughness. Specifically, diminished toughness was an inevitable consequence of achieving hardness over that of current spring steel. In increasing the strength of suspension springs, toughness also had to be greater than that of current steel to ensure reliability in these springs.

SUMMARY OF THE INVENTION

In view of this, it is an object of the present invention to obtain a spring steel that is harder than at present and that is also tougher than at present.

As a result of examining the effect of various elements on the hardness and toughness of steel, the inventors learned that a high-strength spring steel combining both hardness and toughness can be obtained by adjusting the proportions of its various elements.

Specifically, the present invention is a high-strength spring steel having a hardness Hv of at least 600 upon tempered at 350° C. after quenching, and an impact strength of at least 40 J/cm$^2$, comprising 0.40 to 0.70 wt. % carbon, 1.00 to 2.50 wt. % silicon, 0.30 to 0.90 wt. % manganese, 0.50 to 1.50 wt. % nickel, 1.00 to 2.00 wt. % chromium, 0.30 to 0.60 wt. % molybdenum, 0.25 to 0.50 wt. % copper, 0.01 to 0.50 wt. % vanadium, 0.010 to 0.050 wt. % niobium, 0.005 to 0.050 wt. % aluminum, 0.0045 to 0.0100 wt. % nitrogen, 0.005 to 0.050 wt. % titanium, and 0.0005 to 0.0060 wt. % boron, with phosphorus limited to 0.010 wt. % or less, sulfur to 0.010 wt. % or less, and $O_T$ to 0.0015 wt. % or less, and the remainder being composed of iron and unavoidable impurities.

The reasons for limiting the components in the present invention are as follows.

Carbon: Carbon is an element that is effective at increasing strength, but the strength required of spring steel cannot be obtained at less than 0.40 wt. %, and the spring will be too brittle if the content exceeds 0.70 wt. %, so the content range was set at 0.40 to 0.70 wt. %.

Silicon: Silicon is an element that is effective at increasing the strength of steel through solid solution in ferrite, but a spring will not have satisfactory resistance to permanent set in fatigue at a content of less than 1.00 wt. %, and if the content exceeds 2.50 wt. %, then decarburization of the surface will tend to occur in the hot forming of the spring, and there will be an adverse effect on the durability of the spring, so the content range was set at 1.00 to 2.50 wt. %.

Manganese: Manganese is an element that is effective at enhancing the hardenability of steel, and the content must be at least 0.30 wt. %, but exceeding 0.90 wt. % will hamper toughness, so the content range was set at 0.30 to 0.90 wt. %.

Nickel: Nickel is an element that is effective at enhancing the hardenability of steel, and the content must be at least 0.50 wt. %, but if the content exceeds 1.50 wt. %, residual austenite will increase and there will be an adverse effect on the fatigue strength of the spring, so the content range was set at 0.50 to 1.50 wt. %.

Chromium: Chromium is an element that is effective at increasing the strength of steel, but the strength required of a spring cannot be obtained at less than 1.00 wt. %, and toughness will be inferior if the content exceeds 2.00 wt. %, so the content range was set at 1.00 to 2.00 wt. %.

Molybdenum: Molybdenum is an element that ensures hardenability and raises the strength and toughness of steel, but these effects cannot be fully anticipated at less than 0.30 wt. %, and no further benefit will be derived from exceeding 0.60 wt. %, so the content range was set at 0.30 to 0.60 wt. %.

Copper: Copper is an element that boosts corrosion resistance, but this effect will not be realized at less than 0.25 wt. %, and exceeding 0.50 wt. % causes problems such as cracking during hot rolling, so the content range was set at 0.25 to 0.50 wt. %.

Vanadium: Vanadium is an element that raises the strength of steel, but this effect cannot be fully anticipated at less than 0.01 wt. %, and if 0.50 wt. % is exceeded, carbides that do not dissolve in austenite will increase and compromise the spring characteristics, so the content range was set at 0.01 to 0.50 wt. %.

Niobium: Niobium is an element that increases the strength and toughness of steel through the precipitation of fine carbides and making the grains finer, but these effects cannot be fully anticipated at a content of less than 0.010 wt. %, and if the content exceeds 0.50 wt. %, carbides that do not dissolve in austenite will increase and compromise the spring characteristics, so the content range was set at 0.010 to 0.050 wt. %.

Aluminum: Aluminum is an element that is required as a deoxidant and in order to achieve the adjustment of austenite grain size, but the grains will not become finer at a content of less than 0.005 wt. %, whereas castability will tend to suffer if 0.050 wt. % is exceeded, so the range was set at 0.005 to 0.050 wt. %.

Nitrogen: Nitrogen is an element that bonds with aluminum and niobium to form AlN and NbN, serving to reduce the austenite grain size, and through this grain-refining, helps to increase toughness. For this effect to be realized, the content must be at least 0.0045 wt. %. However, nitrogen should be added to keep the amount as small as possible in order to achieve better hardenability by addition of boron, and excessive addition of nitrogen leads to foaming on the ingot surface during solidification and makes it more difficult to cast the steel. To avoid this, the upper limit must be set at 0.0100 wt. %. Therefore, the amount of nitrogen addition was set at 0.0045 to 0.0100 wt. %.

Titanium: Nitrogen in steel bonds with the boron discussed below and forms BN which will cause deterioration of the effect of boron on enhancing hardenability. Titanium is added to prevent such deterioration. Its effect cannot be fully anticipated at a content of less than 0.005 wt. %, but if it is added in too large an amount, there is the possibility that large TiN inclusion will be produced and become origins of fatigue breakdown, so the upper limit was set at 0.050 wt. %.

Boron: Boron strengthens the grain boundary by segregating near the austenite grain boundary. At less than 0.0005 wt. %, its effect cannot be fully anticipated, but exceeding 0.0060 wt. % will provide no further benefit, and the steel will be more brittle, so the upper limit was set at 0.0060 wt. %.

Phosphorus: Phosphorus is an element that lowers the impact value by segregation at the austenite grain boundary, which makes the grain boundary brittle. This problem is pronounced when the phosphorous content is over 0.010 wt. %.

Sulfur: In steel, sulfur is present as an MnS inclusion, and is a cause of shortened fatigue life. Therefore, to reduce inclusions, the upper limit must be set at 0.010 wt. %.

$O_T$: This is the total amount of oxygen as oxide inclusions. If a large quantity of oxygen is contained, there will be many oxide inclusions that will become origins of fatigue fracture, so the content should be as low as possible, and the upper limit is 0.0015 wt. %.

DESCRIPTION OF THE PREFERRED EMBODIMENTS

Figure 1:
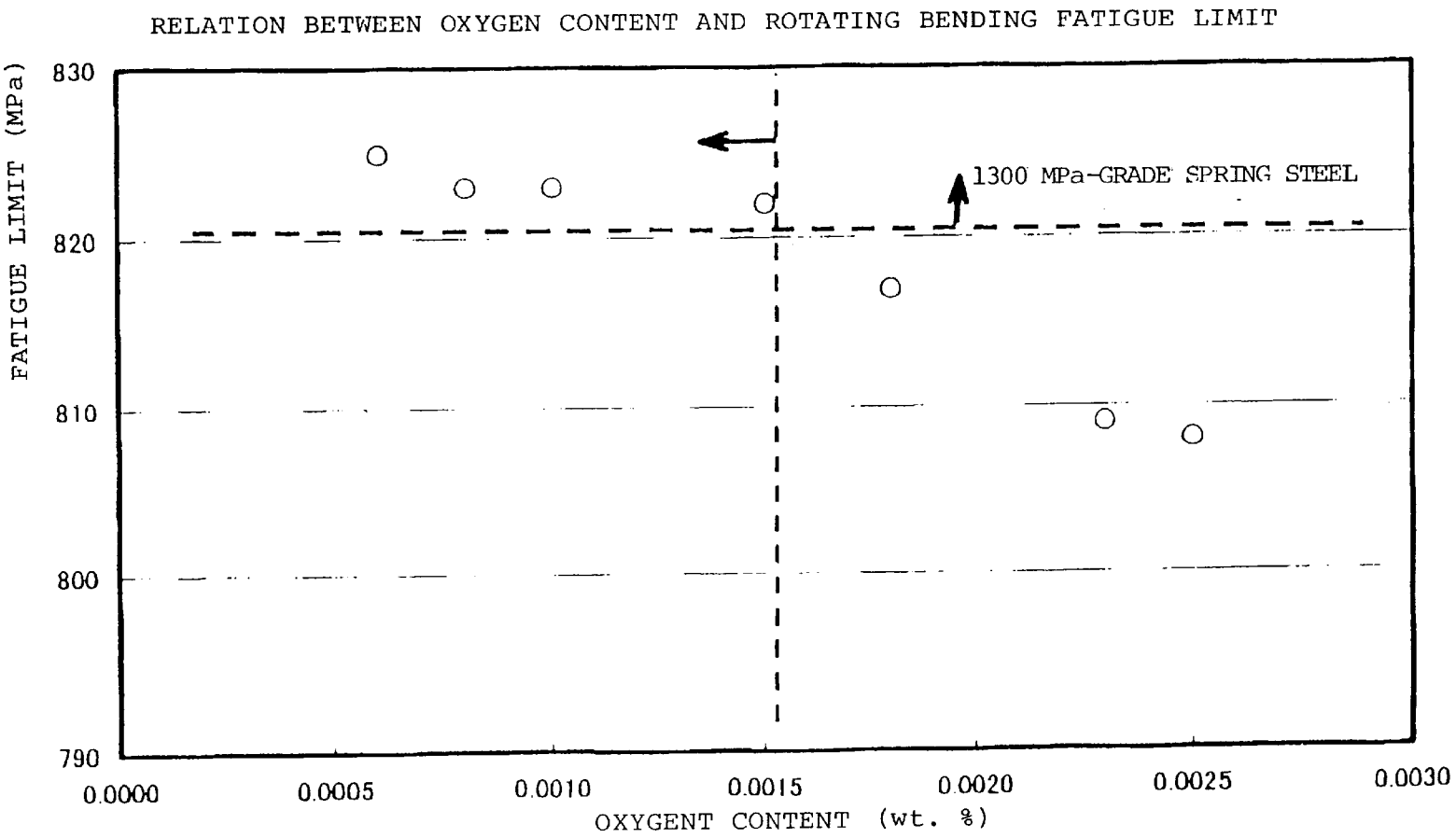
FIG. 1 is a graph of the relation between the oxygen content and the rotating bending fatigue limit.

The present invention will now be described in further detail through specific examples. Table 1 shows the chemical components of the developed steels of the present invention and comparative and conventional steels melted in a large-scale furnace.

| No. | C | Si | Mn | P | S | Ni | Cr | Mo | Cu | V |
|---|---|---|---|---|---|---|---|---|---|---|
| 1 | 0.63 | 0.67 | 1.06 | 0.018 | 0.023 | 0.01 | 0.26 | 0.20 | 0.04 | 0.00 |
| 2 | 0.64 | 0.59 | 1.03 | 0.014 | 0.022 | 0.01 | 0.28 | 0.20 | 0.05 | 0.10 |
| 3 | 0.61 | 1.43 | 0.93 | 0.013 | 0.018 | 0.01 | 0.02 | 0.20 | 0.03 | 0.00 |
| 4 | 0.61 | 1.37 | 0.92 | 0.016 | 0.014 | 0.01 | 0.01 | 0.20 | 0.02 | 0.10 |
| 5 | 0.62 | 0.13 | 1.49 | 0.015 | 0.018 | 0.01 | 0.99 | 0.30 | 0.06 | 0.00 |
| 6 | 0.63 | 0.16 | 1.54 | 0.023 | 0.013 | 0.01 | 0.01 | 0.30 | 0.05 | 0.10 |
| 7 | 0.63 | 0.19 | 2.09 | 0.020 | 0.014 | 0.02 | 0.02 | 0.30 | 0.04 | 0.00 |
| 8 | 0.63 | 0.20 | 2.07 | 0.025 | 0.013 | 0.01 | 0.01 | 0.30 | 0.03 | 0.10 |
| 9 | 0.65 | 1.75 | 0.82 | 0.026 | 0.025 | 0.01 | 0.15 | 0.01 | 0.02 | 0.20 |
| 10 | 0.60 | 0.99 | 1.40 | 0.021 | 0.012 | 0.02 | 0.28 | 0.20 | 0.07 | 0.15 |
| 12 | 0.57 | 1.53 | 0.80 | 0.015 | 0.020 | 0.02 | 0.73 | 0.01 | 0.05 | 0.19 |
| 14 | 0.52 | 0.82 | 0.61 | 0.014 | 0.017 | 2.06 | 1.01 | 0.40 | 0.03 | 0.13 |
| 15 | 0.52 | 1.84 | 0.46 | 0.022 | 0.005 | 0.05 | 1.17 | 0.11 | 0.06 | 0.10 |
| 16 | 0.53 | 1.80 | 0.47 | 0.013 | 0.006 | 0.05 | 1.16 | 0.05 | 0.06 | 0.05 |
| 17 | 0.52 | 1.82 | 0.47 | 0.013 | 0.005 | 0.05 | 1.17 | 0.11 | 0.41 | 0.10 |
| 18 | 0.43 | 1.63 | 0.20 | 0.013 | 0.006 | 0.34 | 1.05 | 0.00 | 0.22 | 0.15 |
| 19 | 0.57 | 1.50 | 0.77 | 0.016 | 0.023 | 0.01 | 0.72 | 0.01 | 0.06 | 0.00 |
| 20 | 0.65 | 1.81 | 0.82 | 0.013 | 0.019 | 0.01 | 0.05 | 0.01 | 0.04 | 0.00 |
| 21 | 0.50 | 1.50 | 0.60 | 0.020 | 0.018 | 1.47 | 1.00 | 0.77 | 0.07 | 0.10 |
| 101 | 0.50 | 1.50 | 0.63 | 0.008 | 0.005 | 0.99 | 1.02 | 0.37 | 0.35 | 0.41 |
| 102 | 0.49 | 1.52 | 0.64 | 0.009 | 0.006 | 0.51 | 1.02 | 0.57 | 0.25 | 0.10 |
| 103 | 0.46 | 1.52 | 0.63 | 0.006 | 0.007 | 0.50 | 1.53 | 0.36 | 0.31 | 0.10 |
| 104 | 0.70 | 1.05 | 0.44 | 0.008 | 0.007 | 0.51 | 1.03 | 0.30 | 0.33 | 0.01 |
| 105 | 0.44 | 1.93 | 0.65 | 0.007 | 0.008 | 0.60 | 1.55 | 0.37 | 0.25 | 0.50 |
| 106 | 0.50 | 1.46 | 0.65 | 0.009 | 0.008 | 0.51 | 1.03 | 0.58 | 0.44 | 0.10 |
| 107 | 0.52 | 1.64 | 0.90 | 0.009 | 0.006 | 0.56 | 1.09 | 0.52 | 0.42 | 0.11 |
| 108 | 0.51 | 1.69 | 0.65 | 0.006 | 0.006 | 1.50 | 1.23 | 0.37 | 0.40 | 0.10 |
| 109 | 0.52 | 1.68 | 0.65 | 0.007 | 0.006 | 0.25 | 1.58 | 0.37 | 0.50 | 0.10 |
| 110 | 0.52 | 1.62 | 0.69 | 0.008 | 0.009 | 0.52 | 1.57 | 0.59 | 0.37 | 0.11 |
| 111 | 0.52 | 1.63 | 0.70 | 0.008 | 0.008 | 0.51 | 1.51 | 0.56 | 0.33 | 0.11 |
| 112 | 0.52 | 1.57 | 0.70 | 0.007 | 0.008 | 0.52 | 1.57 | 0.58 | 0.34 | 0.10 |
| 113 | 0.52 | 1.60 | 0.70 | 0.005 | 0.009 | 0.52 | 1.58 | 0.60 | 0.36 | 0.11 |
| 114 | 0.53 | 1.62 | 0.70 | 0.004 | 0.007 | 0.52 | 1.59 | 0.59 | 0.36 | 0.11 |
| 115 | 0.49 | 1.65 | 0.56 | 0.009 | 0.008 | 0.52 | 1.55 | 0.52 | 0.31 | 0.11 |
| 116 | 0.49 | 1.69 | 0.56 | 0.006 | 0.010 | 0.52 | 2.00 | 0.30 | 0.25 | 0.10 |
| 117 | 0.49 | 1.67 | 0.56 | 0.007 | 0.009 | 0.31 | 1.57 | 0.52 | 0.28 | 0.10 |
| 118 | 0.51 | 1.64 | 0.59 | 0.008 | 0.008 | 0.51 | 1.55 | 0.37 | 0.33 | 0.08 |
| 119 | 0.49 | 1.66 | 0.60 | 0.010 | 0.009 | 0.52 | 1.56 | 0.36 | 0.29 | 0.09 |
| 120 | 0.49 | 1.61 | 0.41 | 0.008 | 0.005 | 0.52 | 1.54 | 0.37 | 0.30 | 0.08 |
| 121 | 0.50 | 1.58 | 0.41 | 0.008 | 0.006 | 0.52 | 1.55 | 0.37 | 0.27 | 0.09 |
| 122 | 0.40 | 2.49 | 0.30 | 0.010 | 0.007 | 0.52 | 1.56 | 0.37 | 0.29 | 0.09 |

| No. | Nb | Al | Ti | B | O | N | Hardness | CP | Remarks* |
|---|---|---|---|---|---|---|---|---|---|
| 1 | 0.000 | 0.015 | 0.000 | 0.0000 | 0.0035 | 0.0082 | 614 | 21.6 | B |
| 2 | 0.022 | 0.017 | 0.000 | 0.0000 | 0.0022 | 0.0073 | 600 | 26.5 | B |
| 3 | 0.000 | 0.034 | 0.000 | 0.0000 | 0.0020 | 0.0092 | 649 | 18.6 | B |
| 4 | 0.023 | 0.020 | 0.000 | 0.0000 | 0.0031 | 0.0143 | 654 | 24.5 | B |
| 5 | 0.000 | 0.021 | 0.000 | 0.0000 | 0.0028 | 0.0138 | 574 | 25.5 | B |
| 6 | 0.024 | 0.013 | 0.000 | 0.0000 | 0.0026 | 0.0128 | 582 | 26.5 | B |
| 7 | 0.000 | 0.015 | 0.000 | 0.0000 | 0.0021 | 0.0093 | 561 | 27.5 | B |
| 8 | 0.025 | 0.018 | 0.000 | 0.0000 | 0.0018 | 0.0064 | 563 | 26.5 | B |
| 9 | 0.066 | 0.066 | 0.000 | 0.0000 | 0.0022 | 0.0073 | 682 | 22.5 | B |
| 10 | 0.024 | 0.030 | 0.000 | 0.0000 | 0.0024 | 0.0187 | 631 | 17.6 | B |

-continued

| | | | | | | | | | |
|---|---|---|---|---|---|---|---|---|---|
| 12 | 0.022 | 0.024 | 0.000 | 0.0000 | 0.0028 | 0.0102 | 630 | 26.5 | B |
| 14 | 0.000 | 0.019 | 0.000 | 0.0000 | 0.0026 | 0.0124 | 603 | 31.5 | B |
| 15 | 0.024 | 0.029 | 0.000 | 0.0000 | 0.0006 | 0.0065 | 649 | 32.4 | B |
| 16 | 0.023 | 0.023 | 0.000 | 0.0000 | 0.0011 | 0.0071 | 649 | 37.8 | B |
| 17 | 0.025 | 0.048 | 0.000 | 0.0000 | 0.0008 | 0.0097 | 633 | 38.2 | B |
| 18 | 0.000 | 0.045 | 0.052 | 0.0000 | 0.0015 | 0.0091 | 579 | 38.9 | B |
| 19 | 0.000 | 0.037 | 0.000 | 0.0000 | 0.0019 | 0.0153 | 620 | 27.4 | C |
| 20 | 0.000 | 0.021 | 0.000 | 0.0000 | 0.0018 | 0.0121 | 650 | 25.5 | C |
| 21 | 0.025 | 0.030 | 0.000 | 0.0000 | 0.0022 | 0.0125 | 621 | 37.3 | C |
| 101 | 0.032 | 0.025 | 0.043 | 0.0025 | 0.0012 | 0.0048 | 623 | 43.7 | A |
| 102 | 0.026 | 0.034 | 0.026 | 0.0018 | 0.0006 | 0.0078 | 620 | 49.4 | A |
| 103 | 0.024 | 0.027 | 0.028 | 0.0058 | 0.0009 | 0.0084 | 618 | 48.9 | A |
| 104 | 0.010 | 0.031 | 0.032 | 0.0005 | 0.0010 | 0.0088 | 603 | 50.9 | A |
| 105 | 0.026 | 0.028 | 0.020 | 0.0010 | 0.0012 | 0.0093 | 617 | 50.4 | A |
| 106 | 0.026 | 0.030 | 0.035 | 0.0036 | 0.0012 | 0.0065 | 600 | 50.6 | A |
| 107 | 0.028 | 0.037 | 0.038 | 0.0028 | 0.0013 | 0.0050 | 627 | 47.9 | A |
| 108 | 0.027 | 0.005 | 0.050 | 0.0046 | 0.0008 | 0.0082 | 633 | 50.3 | A |
| 109 | 0.028 | 0.031 | 0.023 | 00025 | 0.0012 | 0.0074 | 610 | 42.0 | A |
| 110 | 0.029 | 0.034 | 0.025 | 0.0060 | 0.0008 | 0.0062 | 628 | 49.3 | A |
| 111 | 0.027 | 0.036 | 0.036 | 0.0025 | 0.0011 | 0.0098 | 610 | 50.6 | A |
| 112 | 0.029 | 0.047 | 0.032 | 0.0035 | 0.0008 | 0.0081 | 630 | 43.9 | A |
| 113 | 0.030 | 0.034 | 0.025 | 0.0032 | 0.0015 | 0.0065 | 629 | 45.0 | A |
| 114 | 0.030 | 0.040 | 0.043 | 0.0036 | 0.0008 | 0.0062 | 638 | 47.9 | A |
| 115 | 0.050 | 0.036 | 0.036 | 0.0038 | 0.0009 | 0.0072 | 638 | 52.4 | A |
| 116 | 0.024 | 0.041 | 0.015 | 0.0048 | 0.0011 | 0.0088 | 630 | 54.4 | A |
| 117 | 0.027 | 0.041 | 0.048 | 0.0025 | 0.0014 | 0.0072 | 632 | 49.4 | A |
| 118 | 0.024 | 0.034 | 0.011 | 0.0060 | 0.0007 | 0.0090 | 622 | 44.5 | A |
| 119 | 0.026 | 0.042 | 0.028 | 0.0025 | 0.0011 | 0.0053 | 615 | 49.4 | A |
| 120 | 0.021 | 0.030 | 0.032 | 0.0029 | 0.0014 | 0.0059 | 614 | 49.7 | A |
| 121 | 0.021 | 0.034 | 0.005 | 0.0040 | 0.0013 | 0.0045 | 623 | 49.0 | A |
| 122 | 0.021 | 0.050 | 0.0034 | 0.0029 | 0.0014 | 0.0063 | 602 | 57.9 | A |

Remarks:
Hardness: Hv, Charpy Value Cp: J/cm$^2$, Component Analysis Value: wt. %
*A: Developed Steel, B: Comparative Steel, C: Conventional Steel Table 1 shows the impact value and hardness of each sample upon tempered at 350° C. after quenching. In every case the developed steel (marked "A") of the present invention had a hardness Hv of at least 600 and an impact value of at least 40 J/cm$^2$, but the impact value of the conventional steel ("C") and comparative steel ("B") did not reach 40 J/cm$^2$ even when the hardness Hv was more than 600.

The present invention is the result of discovering that the oxygen content greatly affects the characteristics of steel, and to test this, alloys of the composition shown in Table 2 were used to conduct a mechanical strength and Ono-type rotating bending fatigue test. These results are also given in Table 2.

Figure 2:
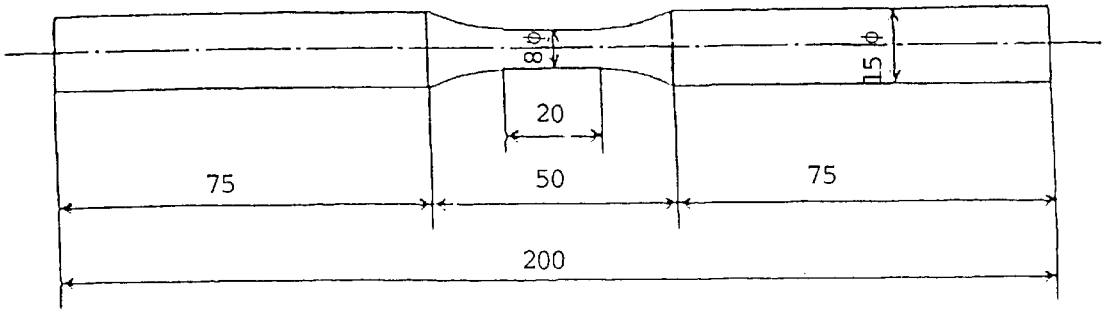
FIG. 2 illustrates the shape of the rotating bending fatigue test piece.

FIG. 1 shows the relation between the oxygen content and the rotating bending fatigue limit. FIG. 2 illustrates the shape of the rotary bending fatigue test piece and the dimensions of the test piece are shown in millimeter units. It was discovered that an oxygen content of 0.0015 wt. % serves as a boundary, above and below which there is a clear difference in the fatigue limit, so the upper limit of the oxygen content was set to 0.0015 wt. % in the present invention.

Test steels #1 to #4 arbitrarily selected from inventive steels and conventional steels, respectively, were tested for durability in a coil spring having the spring characteristics shown in Table 3.The durability test results are given in

TABLE 2

| | Chemical component values wt. % | | | | | | | | | | | | | | Mechanical properties | | Rotating |
|---|---|---|---|---|---|---|---|---|---|---|---|---|---|---|---|---|---|
| No. | C | Si | Mn | P | S | Ni | Cr | Mo | Cu | V | Nb | B | O | N | Hardness *1 | Impact value *2 | fatigue limit *3 |
| 1a | 0.50 | 1.51 | 0.40 | 0.008 | 0.007 | 0.70 | 1.60 | 0.45 | 0.30 | 0.10 | 0.025 | 0.0025 | 0.0006 | 0.0058 | 627 | 45.2 | 825 |
| 2a | 0.49 | 1.50 | 0.42 | 0.007 | 0.006 | 0.71 | 1.61 | 0.43 | 0.32 | 0.10 | 0.025 | 0.0028 | 0.0008 | 0.0061 | 623 | 45.3 | 823 |
| 3a | 0.50 | 1.53 | 0.42 | 0.008 | 0.006 | 0.74 | 1.60 | 0.46 | 0.31 | 0.11 | 0.026 | 0.0029 | 0.0010 | 0.0065 | 624 | 45.7 | 823 |
| 4a | 0.50 | 1.52 | 0.41 | 0.007 | 0.005 | 0.75 | 1.60 | 0.47 | 0.33 | 0.10 | 0.024 | 0.0026 | 0.0015 | 0.0055 | 625 | 44.2 | 822 |
| 5a | 0.49 | 1.53 | 0.43 | 0.008 | 0.007 | 0.74 | 1.61 | 0.44 | 0.33 | 0.11 | 0.026 | 0.0024 | 0.0018 | 0.0067 | 621 | 43.4 | 817 |
| 6a | 0.49 | 1.50 | 0.41 | 0.008 | 0.008 | 0.73 | 1.60 | 0.46 | 0.33 | 0.11 | 0.026 | 0.0026 | 0.0023 | 0.0064 | 622 | 43.2 | 809 |
| 7a | 0.50 | 1.52 | 0.42 | 0.009 | 0.009 | 0.72 | 1.61 | 0.46 | 0.32 | 0.10 | 0.025 | 0.0024 | 0.0025 | 0.0060 | 624 | 44.2 | 808 |

Remarks:
*1: Hardness: Hv
*2: Charpy Value Cp: J/cm$^2$
*3: Fatigue limit: MPa

Table 4.Two types of durability test were conducted under stress conditions of (A) 100 to 1300 MPa and (B) 500 to 1300 MPa. In table 4, "40.0 halted" means that the test steel could endure even at the durability test of $40.0\times10^4$ cycles without breakage and the durability test was halted at this point. The test results other than "40.0 halted" means that the test steels were broken at the cycles shown in Table 4.

TABLE 3

| | |
|---|---|
| Wire diameter (mm) | 11.5 |
| Average coil diameter (mm) | 115.0 |
| Effective number of coils | 4.3 |
| Total number of coils | 5.5 |
| Free height (mm) | 307.6 |
| Spring coefficient (N/mm) | 26.17 |

TABLE 4

| Stress conditions (MPa) | | Durability test cycles ($\times10^4$) Present invention steel | Conventional steel |
|---|---|---|---|
| A | 100–300 | #1 15.6 broke | #1 5.1 broke |
| | | #2 12.1 broke | #2 4.7 broke |
| | | #3 17.2 broke | #3 8.5 broke |
| | | #4 10.2 broke | #4 4.9 broke |
| B | 500–1300 | #1 40.0 halted | #1 12.7 broke |
| | | #2 40.0 halted | #2 15.3 broke |
| | | #3 40.0 halted | #3 12.5 broke |
| | | #4 40.0 halted | #4 13.2 broke |
| Hardness (HV) | | 620–628 | 523–531 |

As is clear from the results in Table 4 above, the service life was greatly extended compared to the conventional steel under the A conditions, in which the stress amplitude was large, and a service life of 5 over 400,000 cycles was obtained under the B conditions, in which the stress amplitude was relatively small.

The present invention yields a high-strength spring steel whose hardness and toughness are both better that those of existing spring steel.

What is claimed is:

1. A high-strength spring steel having an Hv of at least 600 and an impact value of at least 40 J/cm$^2$, comprising 0.40 to 0.70 wt. % carbon, 1.00 to 2.50 wt. % silicon, 0.30 to 0.90 wt. % manganese, 0.50 to 1.50 wt. % nickel, 1.00 to 2.00 wt. % chromium, 0.30 to 0.60 wt. % molybdenum, 0.25 to 0.50 wt. % copper, 0.01 to 0.50 wt. % vanadium, 0.010 to 0.050 wt. % niobium, 0.005 to 0.050 wt. % aluminum, 0.0045 to 0.0100 wt. % nitrogen, 0.005 to 0.050 wt. % titanium, and 0.0005 to 0.0060 wt. % boron, with phosphorus limited to 0.010 wt. % or less, sulfur to 0.010 wt. % or less, and $O_T$ to 0.0015 wt. % or less, and the remainder being composed of iron and unavoidable impurities.

2. The high-strength spring steel according to claim 1, wherein the carbon content is from about 0.40 wt. % to about 0.53 wt. %.

3. The high-strength spring steel according to claim 2, wherein the carbon content is from about 0.49 wt. % to about 0.52 wt. %.

4. The high-strength spring steel according to claim 1, wherein the silicon content is from about 1.0 wt. % to about 1.60 wt. %.

5. The high-strength spring steel according to claim 4, wherein the silicon content is from about 1.46 wt. % to about 1.50 wt. %.

6. The high-strength spring steel according to claim 1, wherein the manganese content is from about 0.30 wt. % to about 0.56 wt. %.

7. The high-strength spring steel according to claim 1, wherein the phosphorus content is less than 0.007 wt. %.

8. The high-strength spring steel according to claim 1, wherein the sulfur content is less than 0.005 wt. %.

9. The high-strength spring steel according to claim 1, wherein the copper content is from about 0.25 wt. % to about 0.35 wt. %.

10. The high-strength spring steel according to claim 1, wherein the nickel content is from about 0.50 wt. % to about 0.60 wt. %.

11. The high-strength spring steel according to claim 1, wherein the chromium content is from about 1.23 wt. % to about 1.55 wt. %.

12. The high-strength spring steel according to claim 1, wherein the molybdenum content is from about 0.3 wt. % to about 0.52 wt. %.

13. The high-strength spring steel according to claim 1, wherein the vanadium content is from about 0.01 wt. % to about 0.1 wt. %.

14. The high-strength spring steel according to claim 1, wherein the niobium content is from about 0.010 wt. % to about 0.026 wt. %.

15. The high-strength spring steel according to claim 1, wherein the boron content is from about 0.0018 wt. % to about 0.0032 wt. %.

16. The high-strength spring steel according to claim 1, wherein the titanium content is from about 0.025 wt. % to about 0.035 wt. %.

17. The high-strength spring steel according to claim 1, wherein the $O_T$ content is less than 0.0010 wt. %.

18. The high-strength spring steel according to claim 1, wherein the nitrogen content is from about 0.0045 wt. % to about 0.0072 wt. %.

19. The high-strength spring steel according to claim 1, wherein the aluminum content is from about 0.005 wt. % to about 0.028 wt. %.

20. A high-strength spring steel having an Hv of at least 600 and an impact value of least 40 J/cm$^2$, comprising about 0.49 to about 0.52 wt. % carbon, about 1.46 to about 1.50 wt. % silicon, about 0.30 to about 0.56 wt. % manganese, about 0.50 to about 0.60 wt. % nickel, about 1.23 to about 1.55 wt. % chromium, about 0.30 to about 0.52 wt. % molybdenum, about 0.25 to about 0.35 wt. % copper, about 0.01 to about 0.1 wt. % vanadium, about 0.010 to about 0.026 wt. % niobium, about 0.005 to about 0.028 wt. % aluminum, about 0.0045 to about 0.0072 wt. % nitrogen, about 0.025 to about 0.035 wt. % titanium, and about 0.0018 to 0.0032 wt. % boron, with phosphorus limited to 0.007 wt. % or less, sulfur to about 0.005 wt. % or less, and $O_T$ to 0.0010 wt. % or less, and the remainder being composed of iron and unavoidable impurities.

* * * * *